United States Patent [19]

Tyllinen et al.

[11] 4,305,818

[45] Dec. 15, 1981

[54] VACUUM SEWAGE SYSTEM

[75] Inventors: Yrjö Tyllinen, Vantaa; Kaj Nyman, Helsinki, both of Finland

[73] Assignee: Oy E. Sarlin AB, Finland

[21] Appl. No.: 184,318

[22] Filed: Sep. 5, 1980

[30] Foreign Application Priority Data

Sep. 7, 1979 [FI] Finland ..... 792777

[51] Int. Cl.[3] ..... C02C 1/26

[52] U.S. Cl. ..... 210/170; 210/97; 210/195.3

[58] Field of Search ..... 210/170, 195.3, 103, 210/104, 137, 97

[56] References Cited

U.S. PATENT DOCUMENTS

| | | | |
|---|---|---|---|
| 3,306,449 | 2/1967 | Minegishi | 210/195.3 |
| 3,400,822 | 9/1968 | McKeown | 210/195.3 |
| 3,419,146 | 12/1968 | Koulovatos | 210/195.3 |
| 3,925,206 | 12/1975 | Bea | 210/710 |
| 4,139,470 | 2/1979 | Stagemeyer | 210/170 |
| 4,155,851 | 5/1979 | Michael | 210/170 |
| 4,159,248 | 6/1979 | Taylor | 210/195.3 |

*Primary Examiner*—John Adee

*Attorney, Agent, or Firm*—Haseltine and Lake

[57] ABSTRACT

A vacuum sewage system, comprising a collection tank, in which the sewer waste arrives with the aid of vacuum through an entrance pipe and from which it departs from time to time through an exit pipe. The arrival and removal of the sewer waste has been arranged to take place with the aid of one pump. The entrance pipe terminates within the collection tank at a minor distance from the intake aperture of the pump.

5 Claims, 1 Drawing Figure

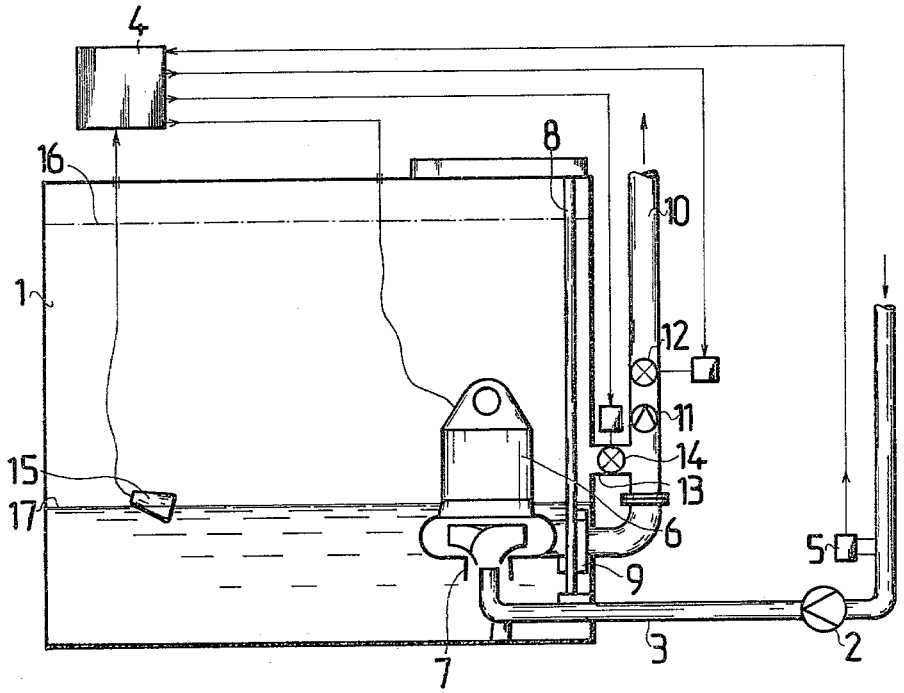
4
16
8
10
1
12
11
14
15
13
17
6
5
9
7
3
2

VACUUM SEWAGE SYSTEM

The present invention concerns a vacuum sewage system comprising a collection tank in which the sewer waste arrives with the aid of vacuum through an entrance pipe and from which it departs from time to time through an exit pipe, the arrival and removal of the sewer waste having been arranged to take place with the aid of one pump.

In vacuum sewage systems, which require a vacuum of about 5 m $H_2O$ height, the vacuum is created in various ways. It is possible to use a separate vacuum pump by which waste is drawn from the network to the collection tank and a separate pump by which the waste is removed from the tank. Because of the use of two pumps the initial cost of the system is high.

In view of this, there have been designed vacuum sewage systems in which one pump is used to serve both tasks. One employs in that case for creation of vacuum, an ejector, the water which this ejector requires being taken from the output side of the pump. However, the use of an ejector is encumbered by the drawback that the ejector may become plugged because it has a reducing nozzle. On the other hand there is the fact that the ejector is an expensive ancillary component.

The object of the present invention is to provide a new vacuum sewage system in which one pump is used and in which no ejector is needed. The invention is characterized in that the entrance pipe terminates in the collection tank at a minor distance from the intake aperture of the pump. In the system of the invention, the vacuum is produced by the velocity energy increment of the liquid circulated by the pump, in the vicinity of the intake aperture. No separate ejector is needed: the intake aperture of the pump together with the mouth of the entrance pipe constitutes a suction means.

The pipeline installations may be laid out in many different ways in accordance with the invention. In one embodiment of the invention there is a draining valve in the exit pipe and before the draining valve, a branch pipe fitted with a circulation valve and which leads back to the collection tank.

In another embodiment of the invention, the mouth aperture of the pump carries a suction cone encircling the end of the entrance pipe. In this way the suction effect is boosted.

In still another favourable embodiment, the end of the entrance pipe is conically narrowing or widening. It is possible in this way to regulate the flow velocity for attainment of suitable suction.

In still another favourable embodiment, the end of the entrance pipe consists of an elastic or flexible material. The aim in that case being that solid foreign matter which cannot pass through the gap between the suction aperture and the end of the entrance pipe can bend or flatten the end of the entrance tube consisting of resilient material, whereby such bodies are admitted into the intake aperture of the pump. One prevents hereby the plugging of the gap between the intake aperture and the end of the entrance pipe.

The invention shall be described in the following with the aid of an example, reference being made to the attached drawing, which schematically illustrates a vacuum sewage system. In the drawing, the reference numeral 1 indicates the collection tank, into which enters from the sewer network the entrance pipe 3, fitted with a check valve 2. The entrance pipe further contains a pressure transducer 5 connected to a control unit 4. The entrance pipe 3 terminates in the collection tank 1 at a minor distance from the intake aperture of the submerged pump 6, this aperture carrying a suction cone 7 encircling the end of the entrance pipe. The motor driving the pump 6 has been connected to the control unit 4. The pump can be raised and lowered along the guides 8. The output side of the pump has been connected by a submerged connector 9 to the exit pipe 10, comprising a check valve 11 and a draining valve 12. The draining valve 12 has been connected to the control unit 4. Before the check valve 11 and draining valve 12, the exit pipe 10 has a branch pipe 13 leading back to the tank 1. In this pipe has been mounted a circulation valve 14, this again being connected to the control unit 4. The liquid level in the tank 1 is monitored by a level governor 15, connected to the control unit 4.

The apparatus depicted in the drawing operates in that the pick-up 5 monitors the vacuum in the sewer network, and when this vacuum has gone down to a value which has been set the pump 6 is started by the control unit 4. The draining valve 12 in the exit pipe is closed in this situation, and the circulation valve 14 in the branch pipe 13 is open. The liquid begins to circulate through the gap between the suction cone 7 and the end of the entrance pipe 3 into the pump 6 and thence to the exit pipe 10 and further through the branch pipe 13 back into the tank. The velocity of the liquid in the gap between the suction cone 7 and the end of the entrance pipe 3 causes a pressure drop and a flow from the entrance pipe into the pump and into the tank until the pressure has gone down far enough and the pressure transducer 5 through the control unit stops the pump 6.

After several periods of operation, the liquid level in the tank will have risen to the level 16. The level governor 15 will then through the control unit 4 start the pump 6 and open the valve 12, and close the valve 14. Now the liquid leaves the tank 1 through the exit pipe 10 until the liquid level has sunk back to the level 17.

In case the gap between the suction cone 7 and the end of the entrance pipe 3 is plugged by foreign matter, cleaning is quite simply accomplished by lifting the pump somewhat. This causes the gap to open and the foreign bodies to come free. This advantage is remarkable particularly when submerged pumps are being used, by reason of its convenience.

It is obvious to a person skilled in the art that different embodiments of the invention may vary within the scope of the claims following below. For instance, all the event described may naturally also be arranged to take place manually. As has been said, the pipe systems and valves may also be arranged in a way other than that described above. It is essential in view of the invention: that the entrance pipe terminates, in the collection tank, at a minor distance from the intake aperture of the pump.

The end of the entrance pipe 3 may consist of a common cylindrical pipe, or it may be conically narrowing and, in some instances, also conically widening. The end of the entrance pipe 3 may also consist of a material other than that of the pipe proper, and it may be elastic or flexible.

The intake aperture of the pump 6 may consist merely of a hole in the pump body. The hole may have sharp or rounded edges. The use of the suction cone 7 depicted in the drawing is not indispensable.

It is obvious that a suction pipe can be connected to the intake aperture of the pump 6. In that case is it possible for the pump to be located outside the collection tank 1 and for the initial end of the suction pipe to be located in the collection tank. The intake aperture mentioned in the claims is then understood to be the mouth aperture of the suction pipe, in the vicinity of which the entrance pipe 3 terminates. On the other hand such an arrangement is conceivable in which the entrance pipe terminates against the side of the suction pipe.

We claim:

1. An improved apparatus for use in a vacuum sewage system, said apparatus comprising; a collection tank, an entrance pipe affixed to said tank for directing sewer waste as it arrives under vacuum through said entrance pipe into said tank and from which it departs from time to time through an exit pipe affixed to said tank, and a pump for directing, the arrival and removal of the sewer waste into and out of said tank, wherein the improvement comprises: having the entrance pipe terminate within the collection tank at a minor distance from the intake aperture of the pump providing vacuum conditions on a suction side of said pump and having liquid within said tank contributing to formation of vacuum.

2. A vacuum sewage system according to claim 1, wherein: in the exit pipe there is provided a draining valve and before the draining valve, there is provided a branch pipe fitted with a circulation valve and whereby said branch pipe leads back to the collection tank.

3. A vacuum sewage system according to claim 1, wherein the intake aperture of the pump carries a suction cone encircling the end of the entrance pipe.

4. A vacuum sewage system according to claim 1, wherein the end of the entrance pipe is conically narrowing.

5. A vacuum sewage system according to claim 1, wherein:

the end of the entrance pipe is conically widening.

* * * * *